US010444682B2

(12) United States Patent
Nakamoto et al.

(10) Patent No.: US 10,444,682 B2
(45) Date of Patent: Oct. 15, 2019

(54) FIXING DEVICE THAT DETECTS A ROTATIONAL STATE OF A ROTATABLE MEMBER BASED ON A TEMPERATURE LOWERING RATE OF A DETECTED TEMPERATURE OF A TEMPERATURE DETECTING MEMBER

(71) Applicant: CANON KABUSHIKI KAISHA, Tokyo (JP)

(72) Inventors: Atsushi Nakamoto, Tokyo (JP); Takanori Mitani, Tokyo (JP); Satoshi Nishida, Numazu (JP); Isamu Takeda, Machida (JP); Masahito Omata, Yokohama (JP); Yasuhito Minamishima, Odawara (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/992,842

(22) Filed: May 30, 2018

(65) Prior Publication Data

US 2018/0348678 A1 Dec. 6, 2018

(30) Foreign Application Priority Data

May 31, 2017 (JP) ..... 2017-107779

(51) Int. Cl.
*G03G 15/20* (2006.01)
*G03G 15/00* (2006.01)

(52) U.S. Cl.
CPC ..... *G03G 15/2053* (2013.01); *G03G 15/2039* (2013.01); *G03G 15/5008* (2013.01);
(Continued)

(58) Field of Classification Search
None
See application file for complete search history.

(56) References Cited

U.S. PATENT DOCUMENTS 7,203,438 B2 4/2007 Omata et al.
7,702,249 B2 4/2010 Nishida
(Continued)

FOREIGN PATENT DOCUMENTS

JP H08-16009 A 1/1996
JP 2001318546 A * 11/2001
(Continued)

*Primary Examiner* — Victor Verbitsky
(74) *Attorney, Agent, or Firm* — Venable LLP

(57) ABSTRACT

A fixing device includes a first rotatable member, a second rotatable member, a heat generating member that heats the first rotatable member, and a temperature detecting member that detects a temperature of the heat generating member. A motor drives one of the first rotatable member and the second rotatable member. In addition, a controller controls the fixing device by causing the motor to rotate in a state in which a predetermined amount of electrical power is supplied to the heat generating member, and then, supply of the electrical power to the heat generating member is stopped. On the basis of a temperature lowering rate of a detected temperature of the temperature detecting member during rotation of said motor, the controller detects, after stopping supply of the electrical power to the heat generating member, a rotational state of the one of the first rotatable member and the second rotatable member.

8 Claims, 14 Drawing Sheets

(52) U.S. Cl.
CPC ..... *G03G 15/657* (2013.01); *G03G 15/2028* (2013.01); *G03G 2215/2035* (2013.01)

(56) References Cited

U.S. PATENT DOCUMENTS

| | | | | |
|---|---|---|---|---|
| 7,787,792 | B2 | 8/2010 | Nishida | |
| 9,417,576 | B2 | 8/2016 | Minamishima et al. | |
| 9,829,839 | B2 | 11/2017 | Ando et al. | |
| 2006/0157464 | A1 | 7/2006 | Omata et al. | |
| 2009/0214242 | A1* | 8/2009 | Ukai ..... | G03G 21/1647 399/67 |
| 2015/0346660 | A1 | 12/2015 | Usui et al. | |
| 2018/0074445 | A1 | 3/2018 | Nishida et al. | |

FOREIGN PATENT DOCUMENTS

| | | | |
|---|---|---|---|
| JP | 2002-072762 | A | 3/2002 |
| JP | 2003-076176 | A | 3/2003 |
| JP | 2015-227983 | A | 12/2015 |

* cited by examiner

| | EMB.1 | EMB.2 | EMB.3 | EMB.4 | EMB.5 | COMP. EX. |
|---|---|---|---|---|---|---|
| IMAGE DETECT | NO | NO | NO | NO | NO | YES |
| ROLLER DEFORMATION | NO | NO | NO | NO | NO | YES |

FIXING DEVICE THAT DETECTS A ROTATIONAL STATE OF A ROTATABLE MEMBER BASED ON A TEMPERATURE LOWERING RATE OF A DETECTED TEMPERATURE OF A TEMPERATURE DETECTING MEMBER

This application claims the benefit of Japanese Patent Application No. 2017-107779, filed on May 31, 2017, which is hereby incorporated by reference herein in its entirety.

FIELD OF THE INVENTION AND RELATED ART

The present invention relates to a fixing device for use with an image forming apparatus, such as a copying machine or a printer, employing an image forming process of an electrophotographic type, for example.

In the image forming apparatus of the electrophotographic type, a toner image transferred on a recording material is fixed on the recording material under application of heat and pressure exerted by a fixing member. It has been widely known that a rotatable member is used as the fixing member, and drive of the fixing member is carried out, in many cases, by a constitution in which power of a motor is transmitted using gears. In a case in which the power is not transmitted to the fixing member during drive of the motor due to failure, or the like, of the gears, although the motor is normally driven, there is a possibility that the fixing member is not rotated and is deformed by being increased in temperature and thus, an image defect occurs.

As a method for solving this problem, a method in which an electroconductive portion and a non-electroconductive portion are provided in mixture along a circumferential direction of the fixing member and a change in electrical resistance therebetween is detected and thus, rotation or non-rotation of the fixing member is discriminated, has been proposed (Japanese Laid-Open Patent Application 2003-76176).

In the conventional method, however, there is a need to process the fixing member in order to discriminate the rotation or the non-rotation of the fixing member, and, therefore, such a problem that durability of the fixing member was deteriorated (lowered) or the image defect due to the deformation of the fixing member was generated arose in some cases.

SUMMARY OF THE INVENTION

A principal object of the present invention is to provide a fixing device capable of suppressing deterioration of durability of a fixing member or an image defect due to deformation of the fixing member.

According to one aspect, the present invention provides a fixing device comprising a first rotatable member, a second rotatable member opposing the first rotatable member and configured to form a nip in cooperation with the first rotatable member so that a recording material, on which a toner image is formed, is nipped and fed in the nip, a heat generating member configured to heat the first rotatable member, a temperature detecting member configured to detect a temperature of the heat generating member, a motor configured to drive one of the first rotatable member and the second rotatable member, and a controller configured to control the fixing device, wherein the controller causes the motor to rotate in a state which predetermined electrical power is supplied to the heat generating member, and then supply of electrical power to the heat generating member is stopped, and, on the basis of a change amount of a detected temperature of the temperature detecting member during rotation of the motor, the controller detects a rotational state of the one of the first rotatable member and the second rotatable member.

Further features of the present invention will become apparent from the following description of exemplary embodiments with reference to the attached drawings.

Figure 4:
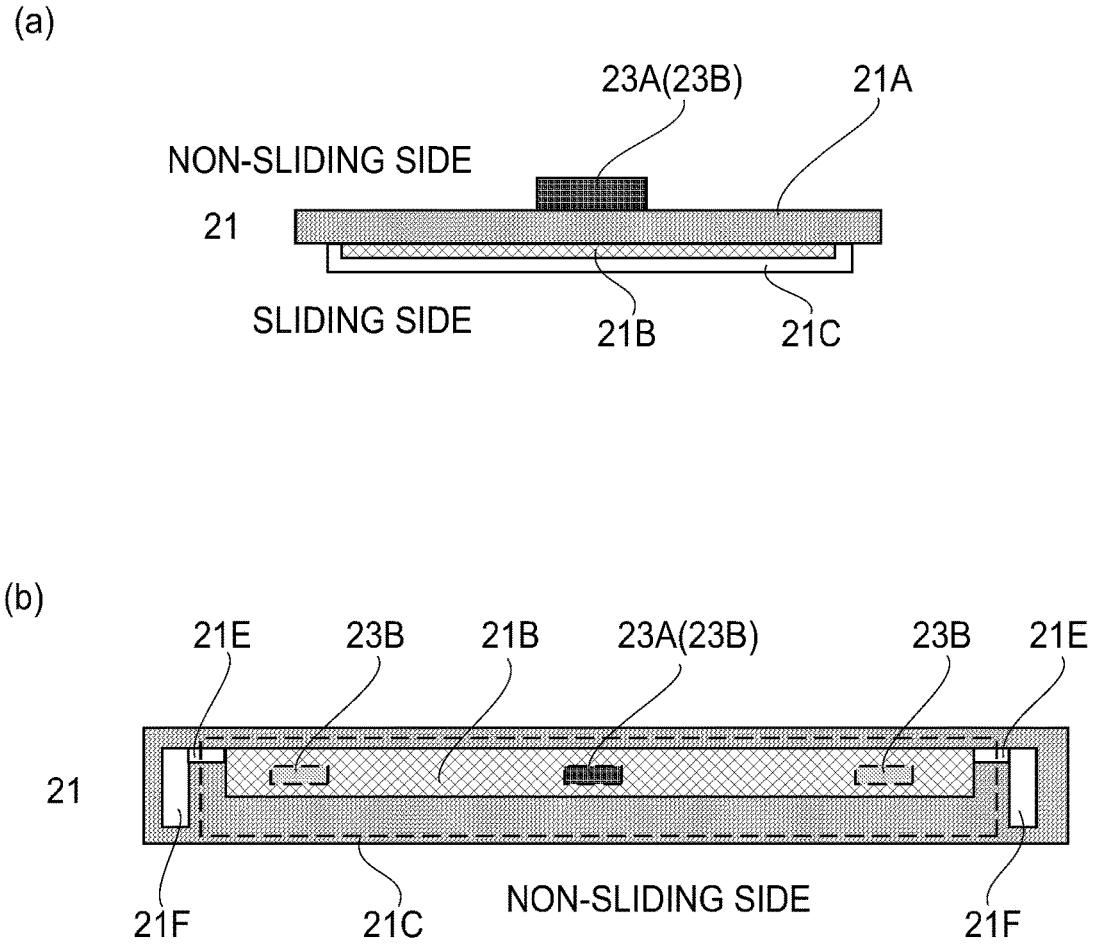

Part (a) of FIG. 4 is a sectional view showing a schematic structure of a ceramic heater, and part (b) of FIG. 4 is a plan view of a non-sliding surface of a film of the ceramic heater.

Figure 5:
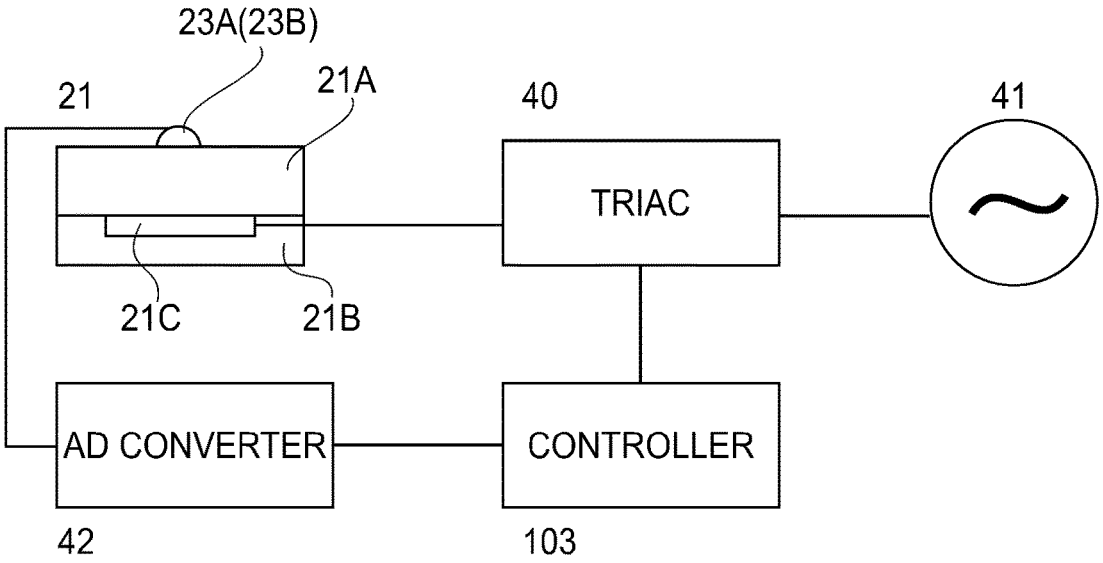

FIG. 5 is a block diagram of an energization control system of the ceramic heater.

Figure 6:
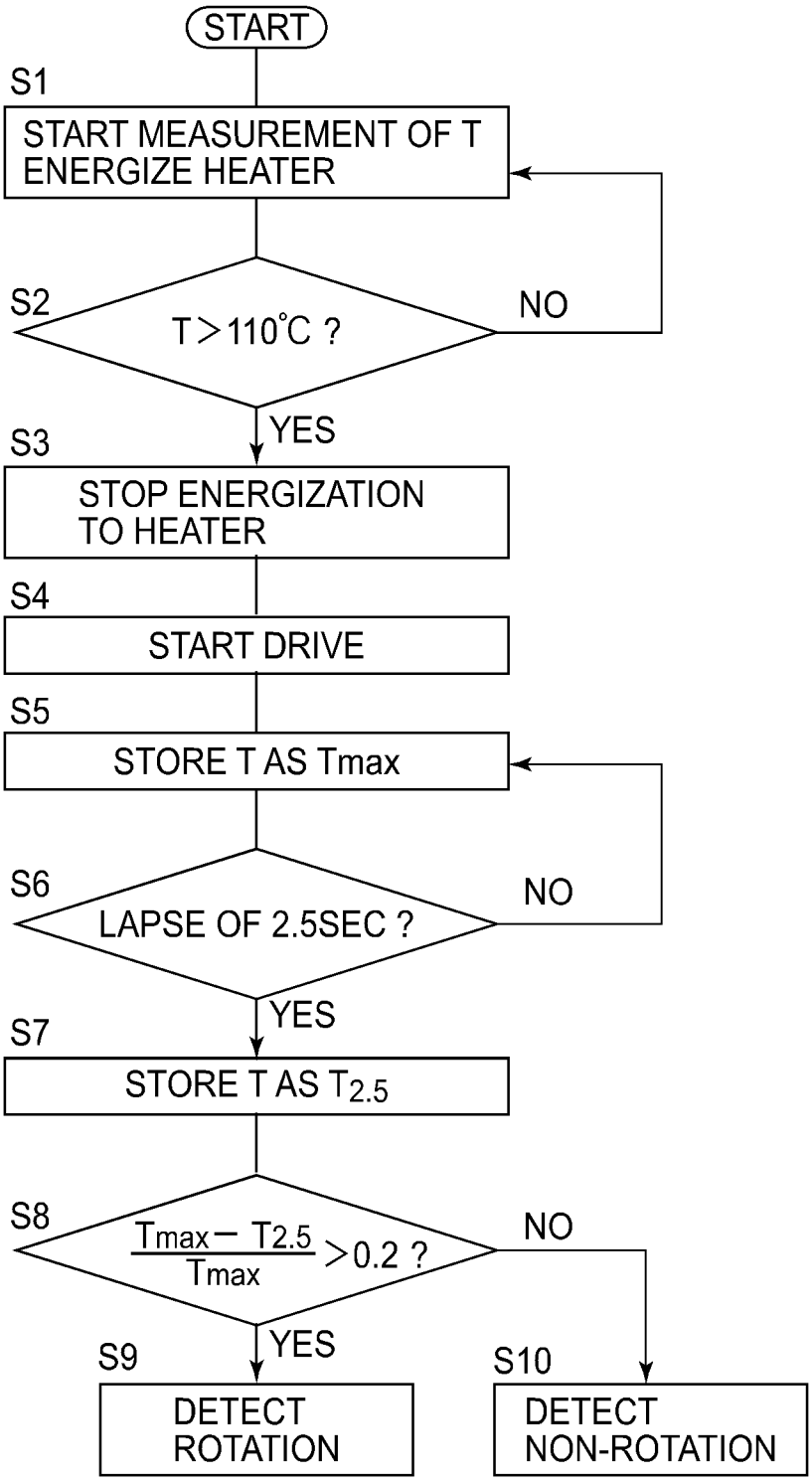

FIG. 6 is a flowchart of rotation detection in First Embodiment.

Figure 7:
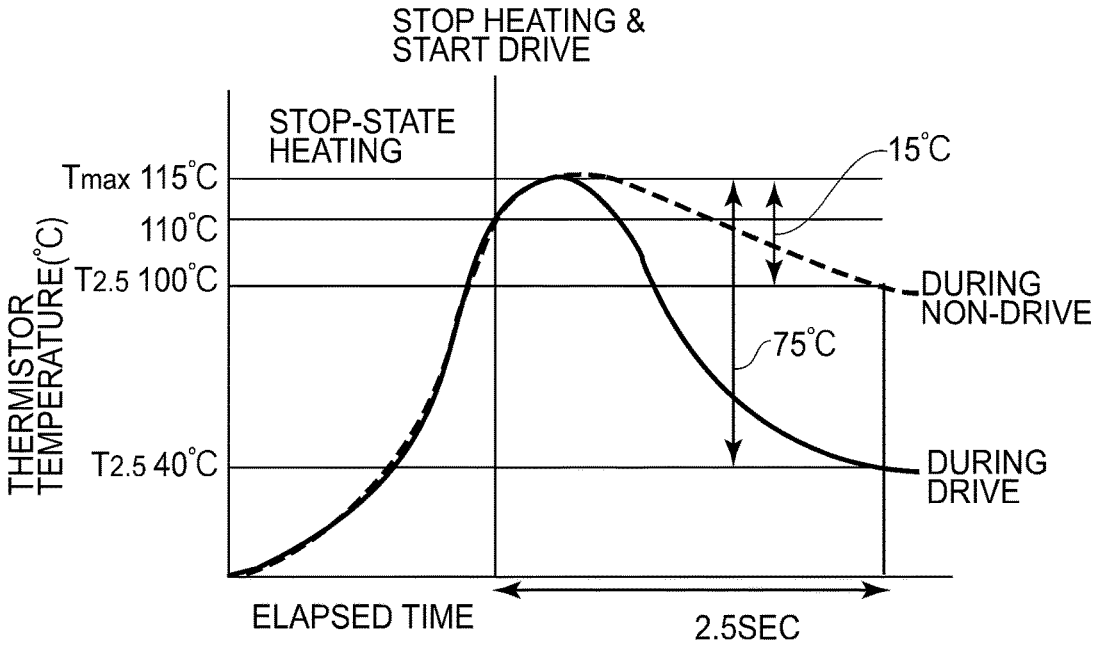

FIG. 7 is a graph showing a change of a thermistor temperature with time in First Embodiment.

Figure 8:
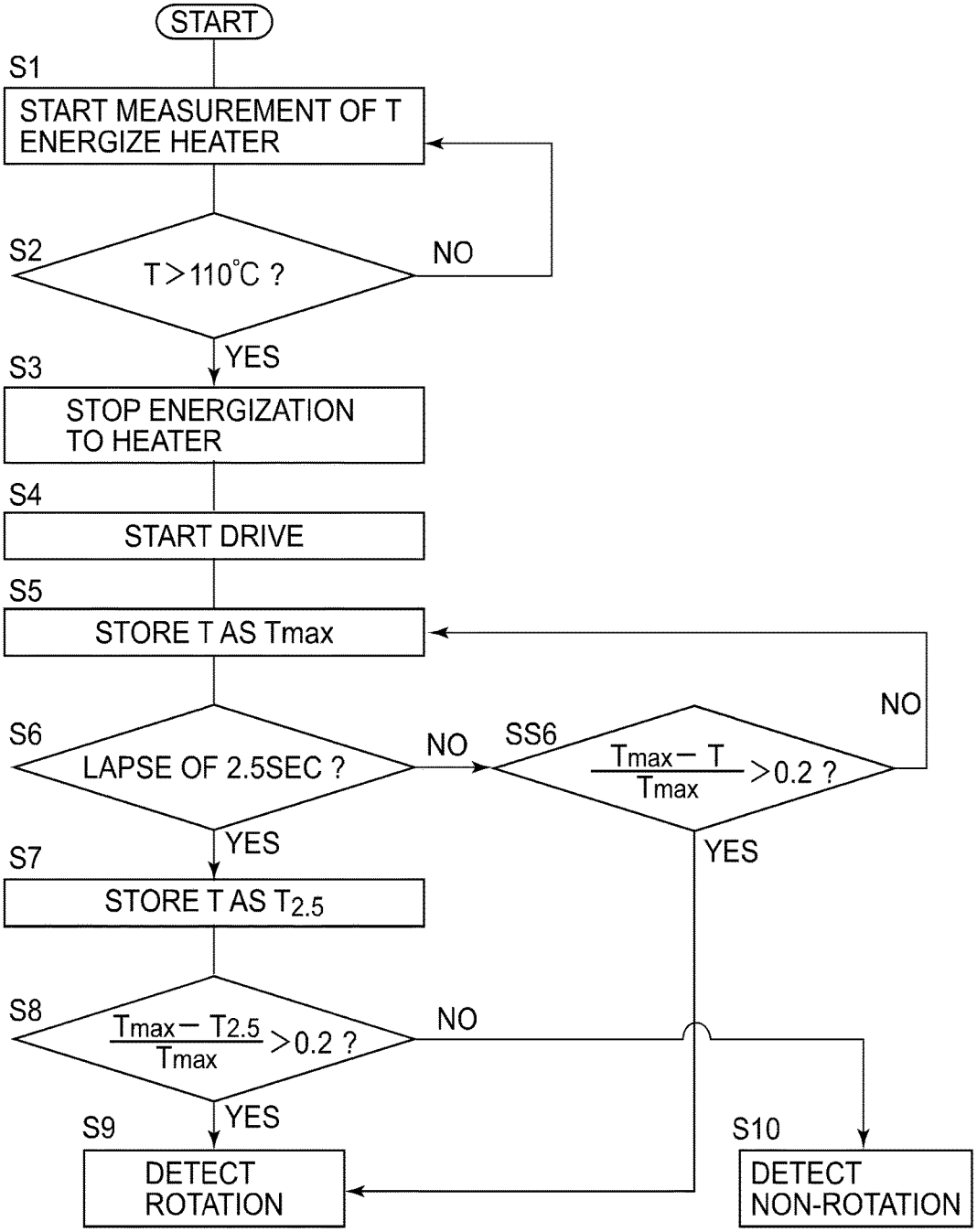

FIG. 8 is a flowchart of detection of rotation in Second Embodiment.

Figure 9:
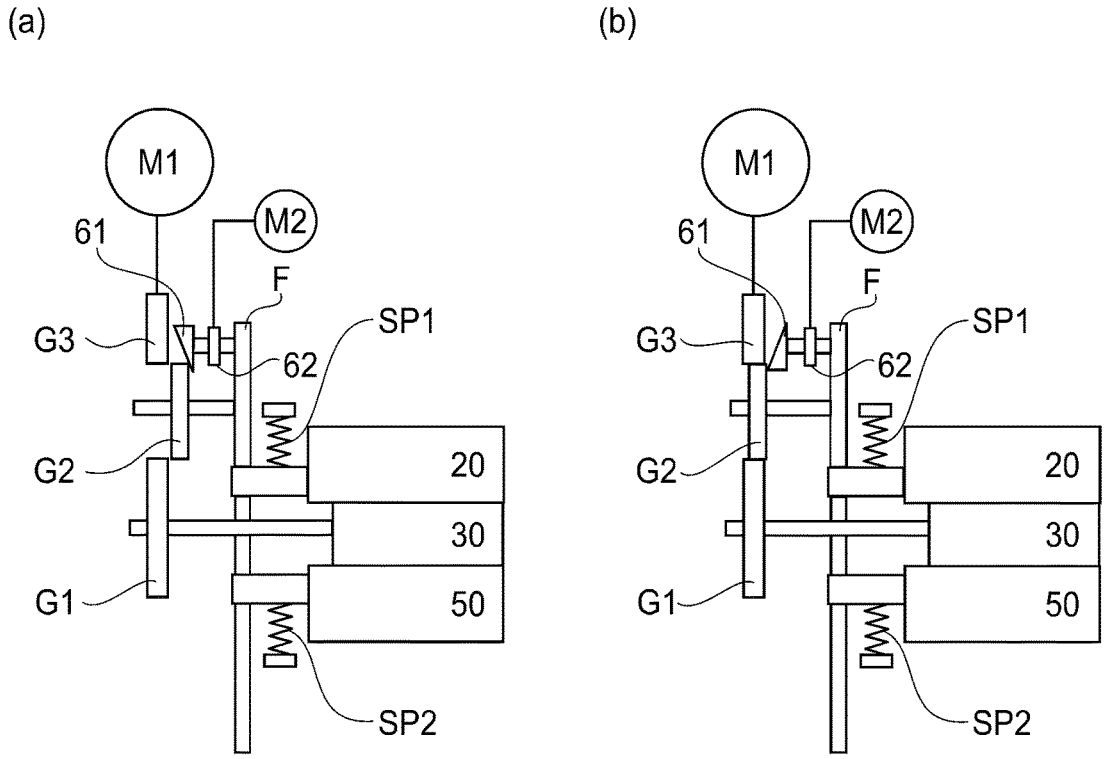

Part (a) of FIG. 9 is a schematic view showing a fixing device including a drive connection mechanism during drive connection, and part (b) of FIG. 9 is a schematic view showing the fixing device during non-drive connection.

Figure 10:
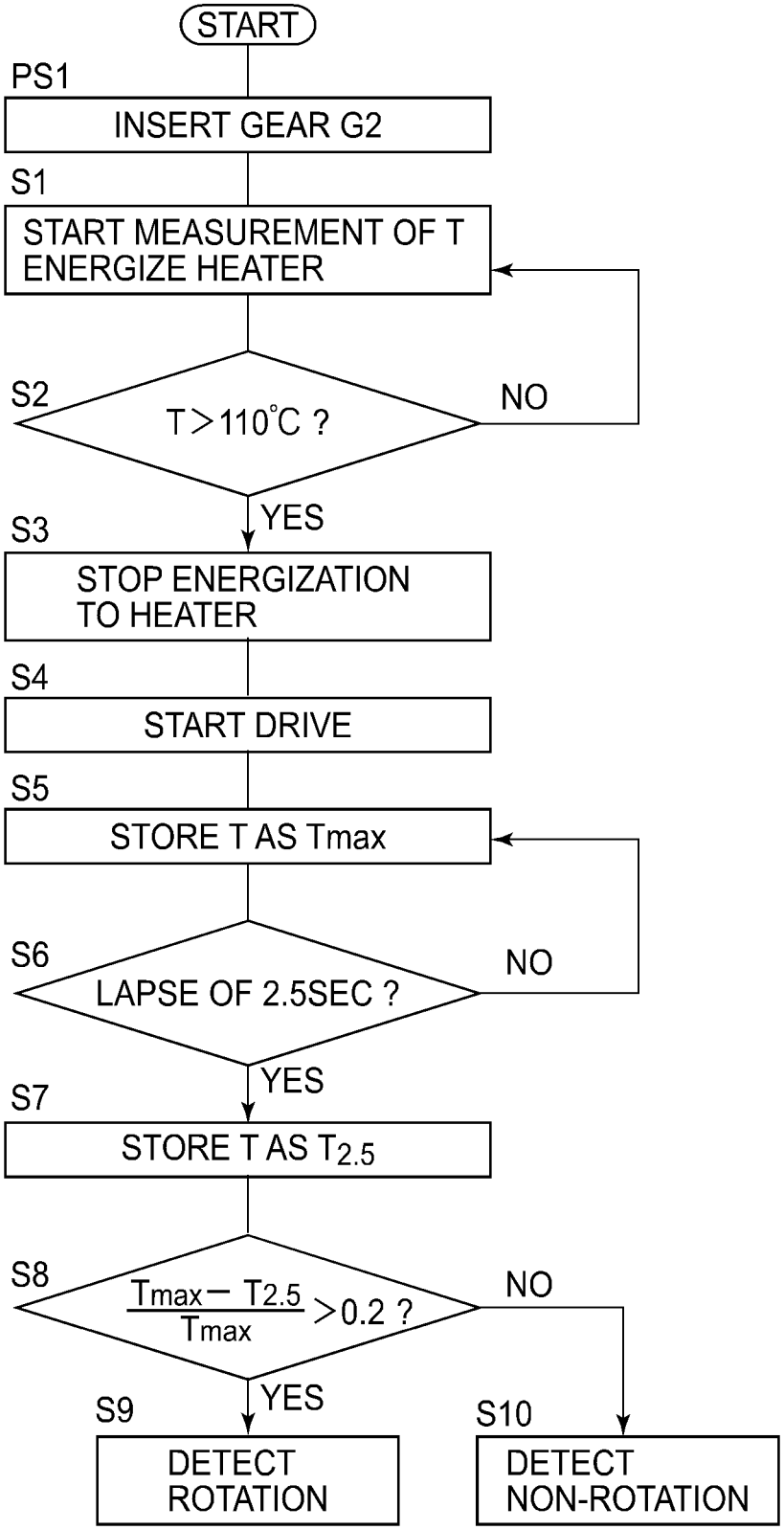

FIG. 10 is a flowchart of detection of rotation in Third Embodiment.

Figure 11:
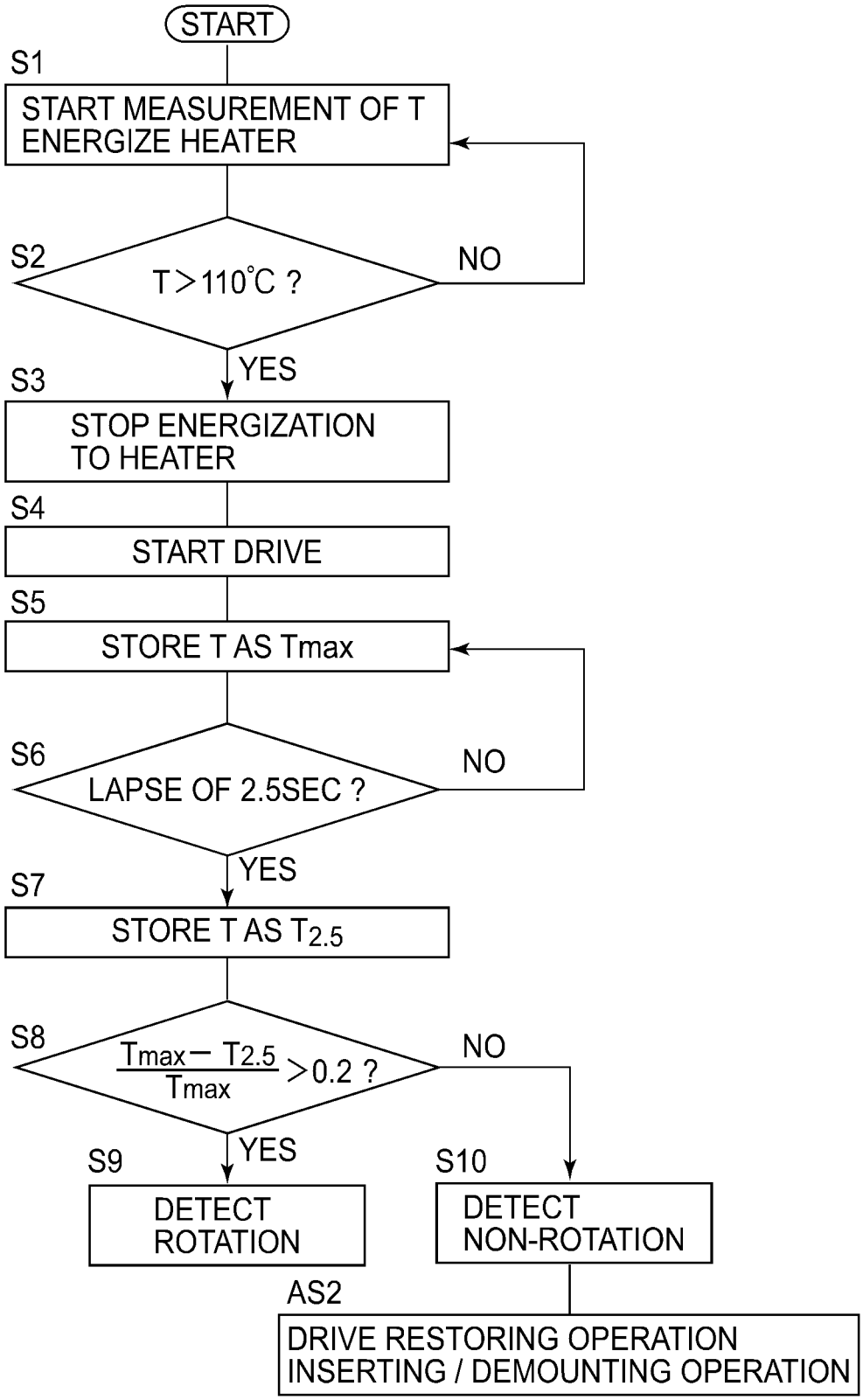

FIG. 11 is a flowchart of detection of rotation in Fourth Embodiment.

Figure 12:
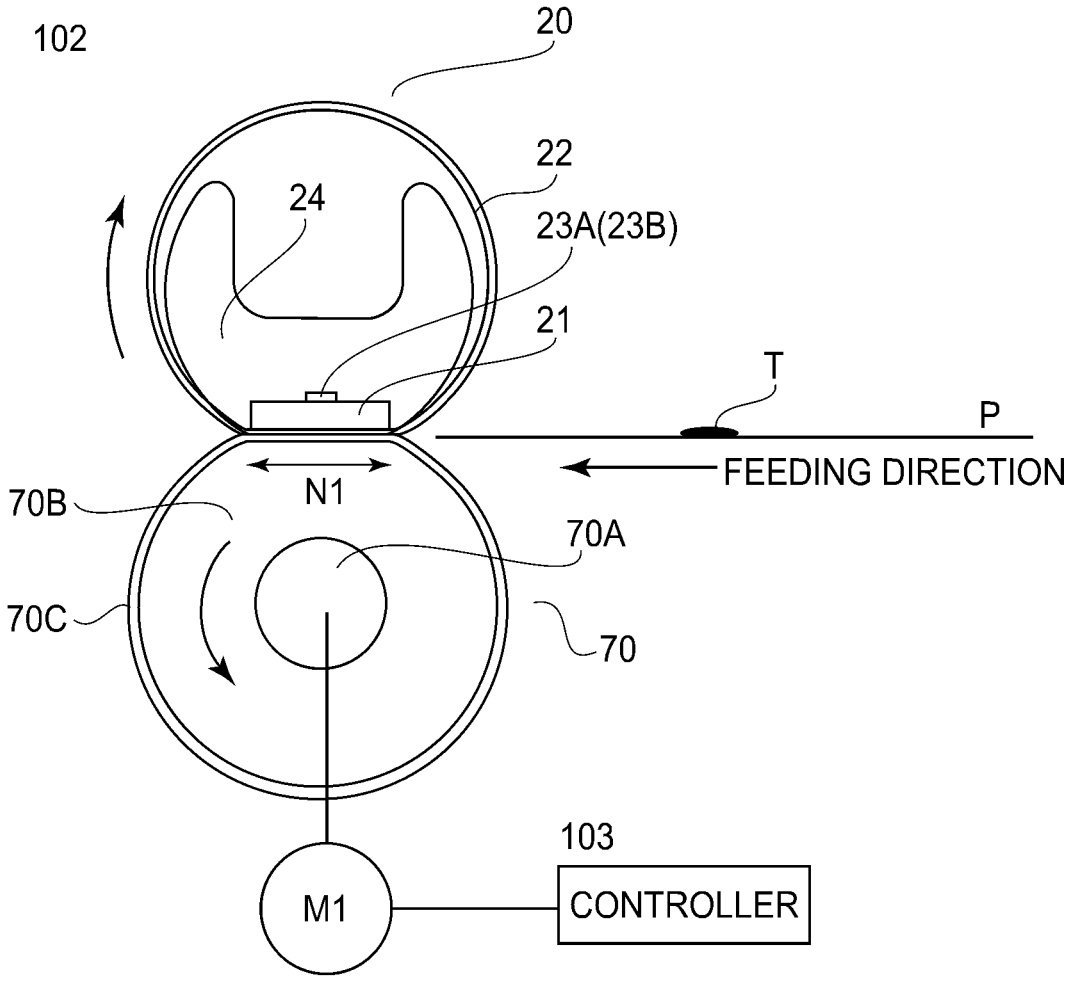

FIG. 12 is a sectional view showing a schematic structure of a fixing device according to Fifth Embodiment.

Figure 13:
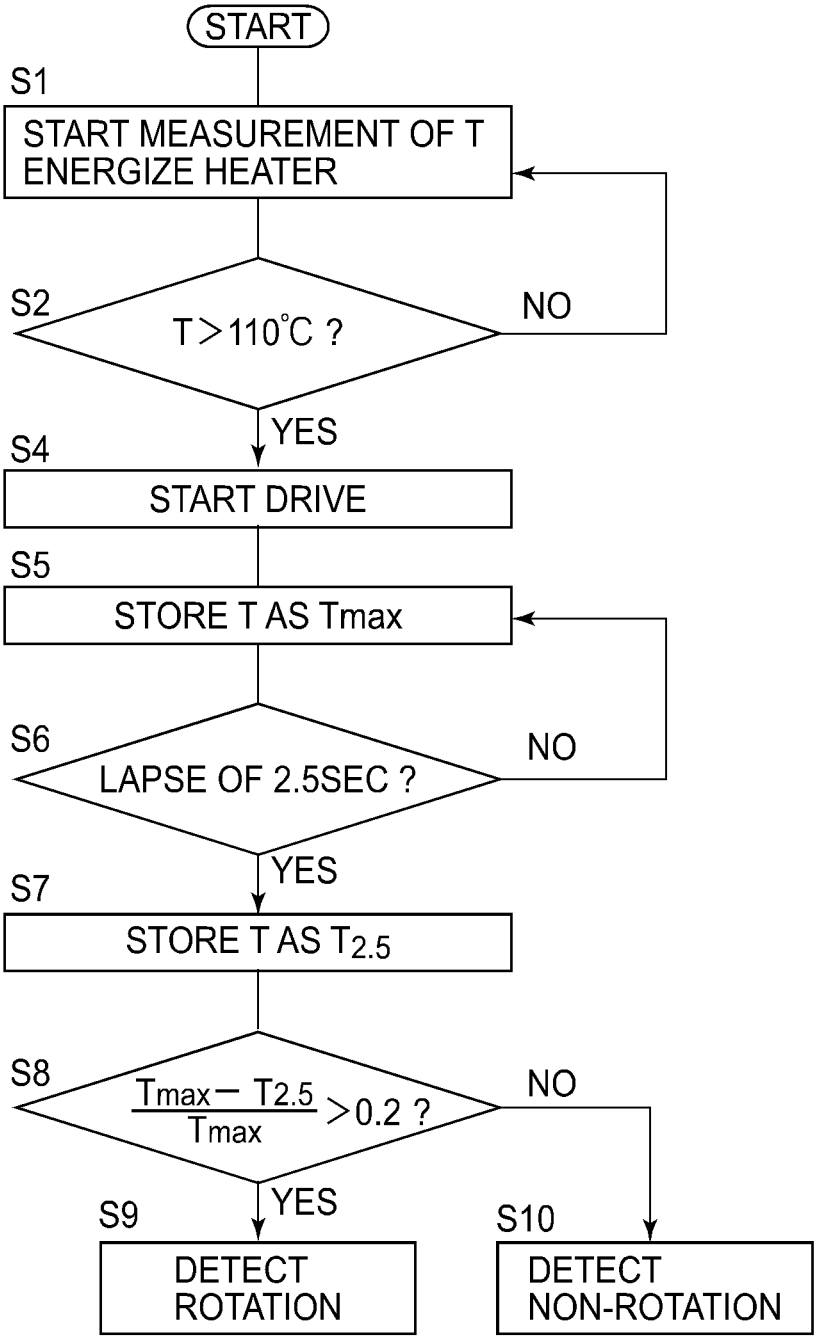

FIG. 13 is a flowchart of detection of rotation in a comparison example.

Figures 14, 15:
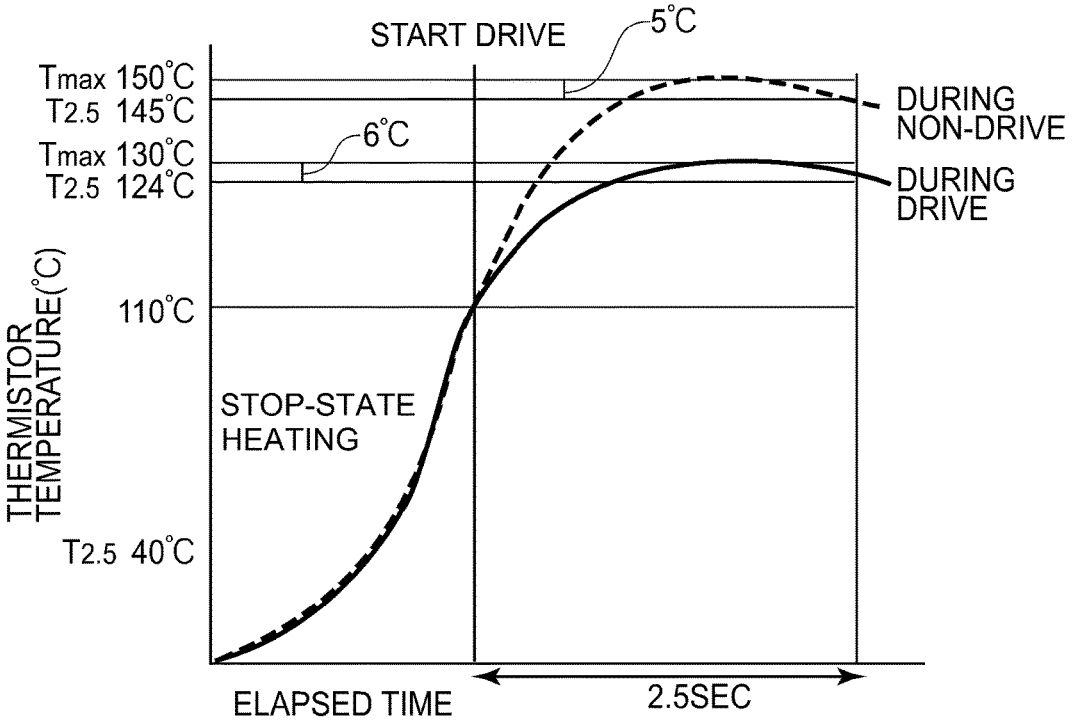

FIG. 14 is a graph showing a change in thermistor temperature with time in the comparison example.

FIG. 15 is a table showing the presence or the absence of an image defect and deformation of a fixing roller.

DESCRIPTION OF EMBODIMENTS

Embodiments of the present invention will be described specifically with reference to the drawings. Although the following embodiments are examples of preferred embodiments of the present invention, the present invention is not limited thereto, and various constitutions thereof can also be replaced with other known constitutions within the scope of the concept of the present invention.

First Embodiment

Image Forming Apparatus

Figure 1:
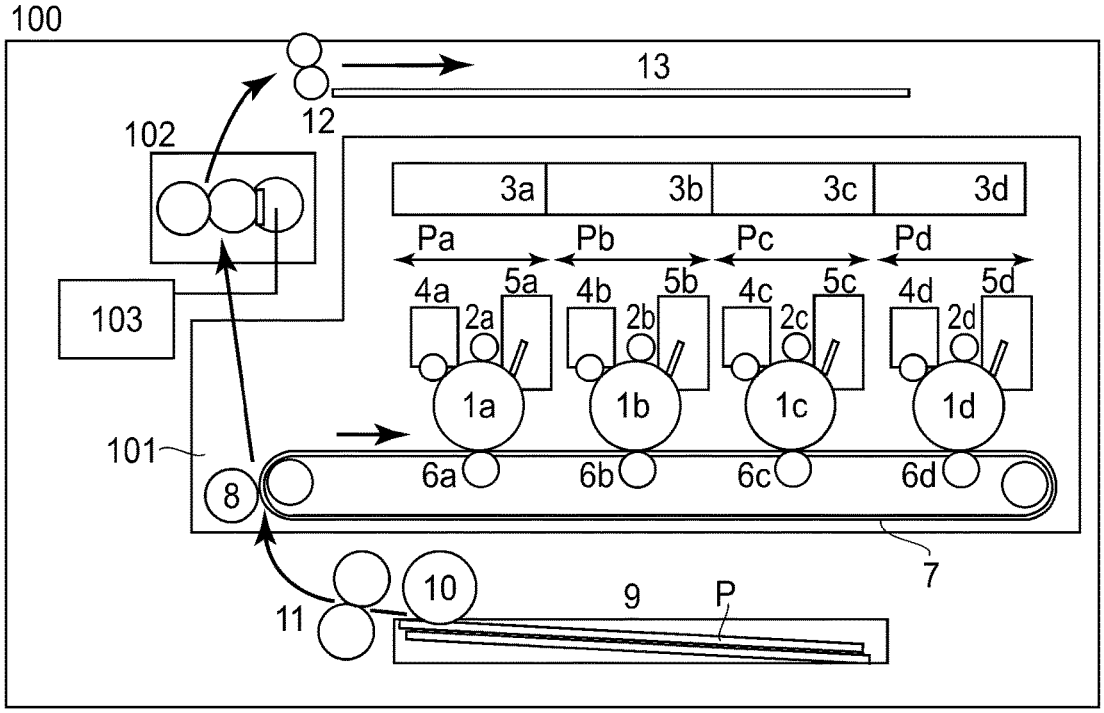
FIG. 1 is a sectional view showing a schematic structure of an image forming apparatus.

FIG. 1 is a sectional view showing a schematic structure of an image forming apparatus (full-color printer) 100 in which a fixing device according to this embodiment is mounted. In the image forming apparatus 100, an image forming portion 101 includes four image forming stations Pa, Pb, Pc, and Pd for yellow, cyan, magenta, and black, respectively. The image forming stations include photosensitive members 1*a*, 1*b*, 1*c*, and 1*d* as image bearing members, charging members 2*a*, 2*b*, 2*c*, and 2*d*, laser scanners 3*a*, 3*b*, 3*c*, and 3*d*, and developing devices 4*a*, 4*b*, 4*c*, and 4*d*, respectively.

The image forming stations further include cleaners 5*a*, 5*b*, 5*c*, and 5*d* for cleaning the photosensitive members, and transfer members 6*a*, 6*b*, 6*c*, and 6*d*, respectively. Further, the image forming stations include a belt 7, as an intermediary transfer member, for feeding toner images transferred from the photosensitive members while carrying the toner images, and a secondary transfer member 8 for transferring the toner images from the belt 7 onto a recording material P, and the like. An operation of the above-described image forming portion 101 is well known and, therefore, will be omitted from detailed description.

The recording materials P accommodated in a cassette 9 are fed one by one by rotation of a roller 10. The fed recording material P is fed by rotation of a feeding roller pair 11 to a secondary transfer nip formed by the belt 7 and the secondary transfer member 8. The recording material P, on which the toner images are transferred at the secondary transfer nip, is sent to a fixing portion (hereafter, referred to as a fixing device) 102, and the toner images are heat-fixed on the recording material P by the fixing device 102. The recording material P coming out of the fixing device 102 is discharged to a discharge portion 13 by rotation of a discharging roller pair 12.

In FIG. 1, a controller 103 controls an entirety of the image forming apparatus 100 and detects rotation or non-rotation (i.e., a rotational state) of a fixing member described later.

Fixing Device 102

Figure 2:
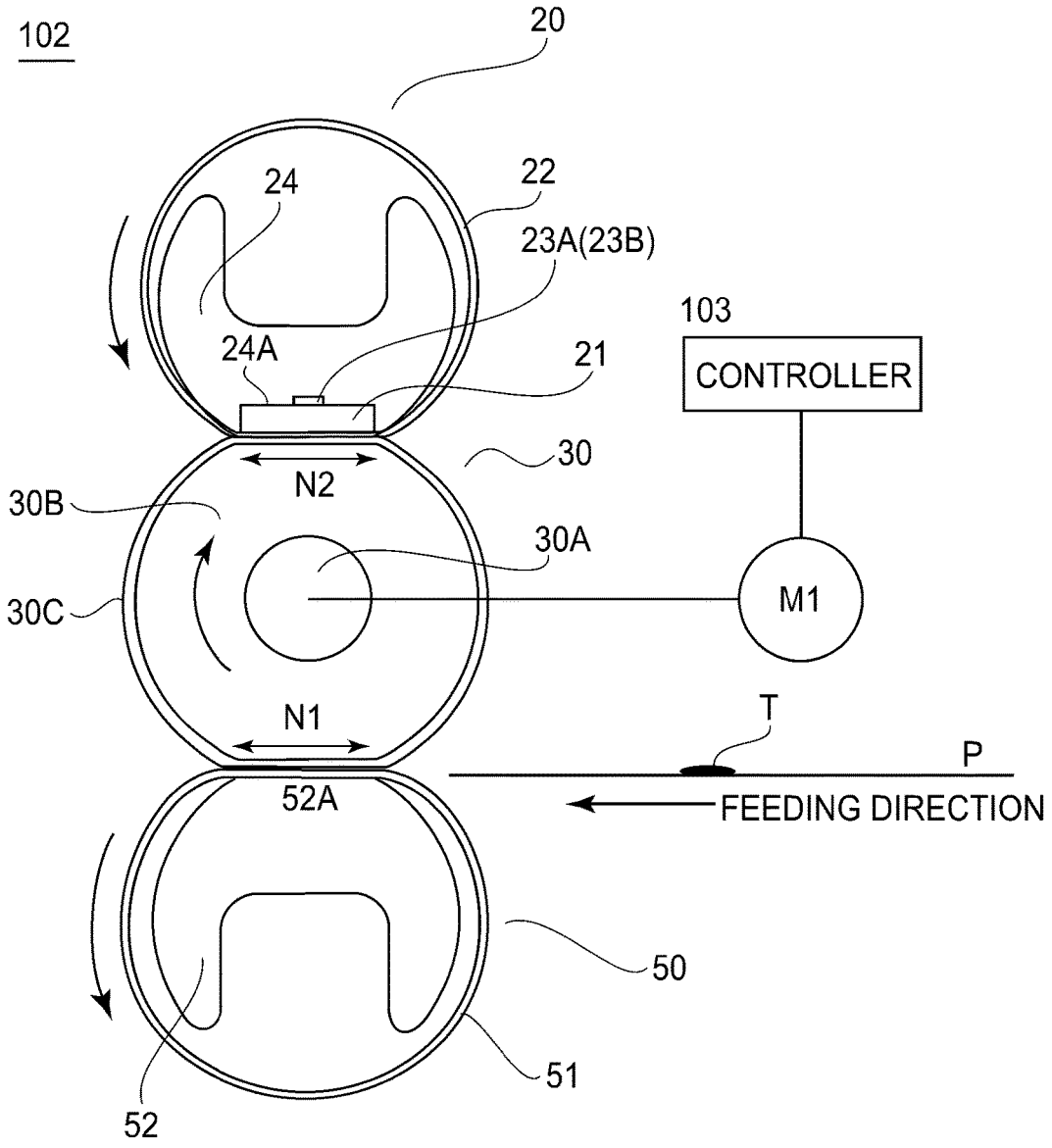
FIG. 2 is a sectional view showing a schematic structure of a fixing device according to First Embodiment.
Figure 3:
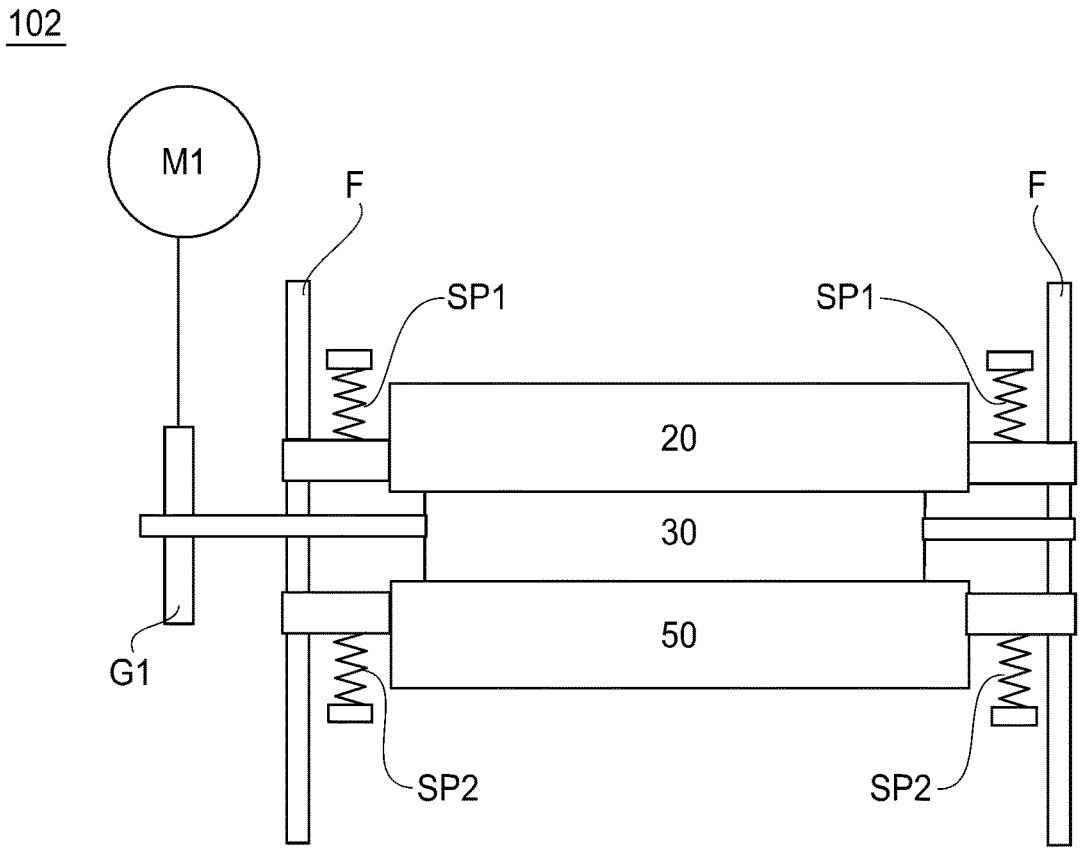
FIG. 3 is a schematic view showing a structure of the fixing device as seen from an upstream side of the fixing device with respect to a recording material feeding direction.

FIG. 2 is a sectional view showing a schematic structure of the fixing device 102. FIG. 3 is a front view showing a schematic structure of the fixing device 102 as seen from an upstream side with respect to a recording material feeding direction. Part (a) of FIG. 4 is a sectional view showing a schematic structure of a ceramic heater 21 used in the fixing device 102, and part (b) of FIG. 4 is a plan view of the ceramic heater 21 as seen from a film non-sliding surface side. FIG. 5 is a block diagram of an energization control system of the ceramic heater 21.

The fixing device 102 shown in FIG. 2 in this embodiment includes a pressing unit 50 including a film (endless belt) 51 as a rotatable member forming a fixing nip N1 in cooperation with a fixing roller 30, as a first rotatable member, described below. The film 51, as a second rotatable member opposing the first rotatable member, and forming the nip with the first rotatable member so as to nip and to feed the recording material P, on which the toner image is formed, is formed of a material containing a thermoplastic resin in a cylindrical shape.

Further, the fixing device 102 includes a heating unit 20 as a heating source for forming a heating nip N2 in cooperation with the fixing roller 30. Each of the pressing unit 50, the fixing roller 30, and the heating unit 20 is an elongated member extending in a direction (hereafter, referred to as a longitudinal direction) perpendicular to the recording material feeding direction.

(1) Fixing Roller 30

The fixing roller 30 includes a metal core 30A consisting of a metal material, such as iron, stainless steel (SUS), or aluminum. On an outer peripheral surface of the metal core 30A between shaft end portions with respect to a longitudinal direction of the metal core 30A, an elastic layer 30B formed with a silicone rubber as a main component is formed, and, on an outer peripheral surface of the elastic layer 30B, a parting layer 30C formed of polytetrafluoroethylene (PTFE), perfluoroalkoxy copolymer (PFA), or fluorinated ethylene propylene (FEP) as a main component is formed.

The shaft end portions of the metal core 30A with respect to the longitudinal direction are rotatably supported by frames F (FIG. 3) of the fixing device 102. To one longitudinal end portion of the metal core 30A, a gear G1, rotated by a motor M, is fixed as shown in FIG. 3.

(2) Heating Unit 20

The heating unit 20 includes the ceramic heater 21, a cylindrical film (endless belt) 22, and a film guide 24. The film guide 24 is formed of a heat-resistant material in a substantially recessed shape (U-shape) in cross section. On a flat surface of the film guide 24 on a side facing the fixing roller 30, a groove 24A is formed along the longitudinal direction. The heater 21 is supported by the groove 24A of the film guide 24.

This heater 21 includes a thin plate-like substrate 21A (part (a) of FIG. 4) formed of ceramic, such as alumina or aluminum nitride, as a main component. On a substrate surface of the substrate 21A on a film sliding surface side, a heat generating resistor 21B formed of silver, palladium, or the like, as a main component, an electroconductive portion 21E electrically connected with the heat generating resistor 21B, and an electrode 21F for energizing the electroconductive portion 21E are printed along the longitudinal direction (part (b) of FIG. 4). Further, on the substrate surface, a protective layer 4*c* formed of glass or a heat-resistant resin material, such as fluorine-containing resin or polyimide, as a main component is formed so as to cover the heat generating resistor 21B (part (a) of FIG. 4).

On the other hand, to a substrate surface of the substrate 21A on a film non-sliding surface, a main thermistor 23A is contacted in a region of a longitudinal central portion of the substrate 21A or in the neighborhood thereof, in which, when a large-size recording material or a small-size recording material is subjected to printing, the recording material always passes. A temperature of the heater 21 in a recording material passing region is detected by the main thermistor 23A. This main thermistor 23A functions as not only a temperature detecting member for temperature control when the recording material is nipped and fed in the nip, but also a temperature detecting member for detecting rotation or non-rotation (i.e., a rotational state) of the fixing member corresponding to a state of energization to the motor described later. These temperature detecting members may, however, also be provided independent of each other.

In each of non-recording material passing regions in which, when the small-size recording material is subjected to printing, the small-size recording material does not pass, a single sub-thermistor 23B is contacted. By these sub-thermistors 23B, temperatures of the heater 21 in the non-recording material passing regions are detected, respectively.

In FIG. 2, the film 22 is formed in a cylindrical shape so that an inner peripheral length of the film is greater than an outer peripheral length of the film guide 24 by a predetermined length, and is externally fitted loosely around the film guide 24 under no tension. As a layer structure of the film 22, a two-layer structure, such that an outer peripheral surface of an endless belt-shaped film base layer formed of polyimide as a main component is coated with an endless belt-shaped surface layer formed of PFA as a main component, is employed.

The above-described heating unit 20 is disposed above the fixing roller 30 in parallel to the fixing roller 30. The longitudinal end portions of the film guide 24 are supported by the frames F (FIG. 3) of the fixing device 102. Further, the longitudinal end portions of the film guide 24 are urged in a perpendicular direction perpendicular to the longitudinal direction of the fixing roller 30 by urging springs SP1 (FIG. 3), so that the film 22 is pressed against an outer peripheral surface of the fixing roller 30 by outer surfaces of the heater 21 and the film guide 24.

As a result, the elastic layer 30B of the fixing roller 30 is pressed and elastically deformed at a position corresponding to the outer peripheral surface of the heater 21, so that a heating nip N2 with a predetermined width is formed by the surface of the fixing roller 30 and the outer peripheral surface of the film 22.

(3) Pressing Unit 50

The pressing unit 50 includes a film 51 and a film guide 52. The film guide 52 is formed of a heat-resistant material in a substantially recessed shape (U-shape) in cross section.

The film 51 is formed in a cylindrical shape so that an inner peripheral length of the film is greater than an outer peripheral length of the film guide 52 by a predetermined length, and is externally fitted loosely around the film guide 52 under no tension. As a layer structure of the film 51, a two-layer structure, such that an outer peripheral surface of an endless belt-shaped film base layer formed of polyether ether ketone (PEEK) as a main component is coated with an endless belt-shaped surface layer formed of PFA as a main component, is employed.

The above-described heating unit 50 is disposed in parallel to the fixing roller 30, and the longitudinal end portions of the film guide 52 are supported by the frames F (FIG. 3) of the fixing device 102. Further, the longitudinal end portions of the film guide 52 are urged in a perpendicular direction perpendicular to the longitudinal direction of the fixing roller 30 by urging springs SP2 (FIG. 3), so that the film 51 is pressed against an outer peripheral surface of the fixing roller 30 by a flat surface 52A of the film guide 52.

As a result, the elastic layer 30B of the fixing roller 30 is pressed and elastically deformed at a position corresponding to the flat surface of the film guide 52, so that a fixing nip N1 with a predetermined width is formed by the surface of the fixing roller 30 and the outer peripheral surface of the film 51.

(4) Heat-Fixing Process/Operation

A heat-fixing process (also referred to as an operation) of the fixing device 102 will be described with reference to FIG. 2. The controller 103, including a central processing unit (CPU) and memories, such as read only memory (ROM) and a random access memory (RAM), rotationally drives the motor M1 in response to a print signal, so that the motor M1 rotates the fixing roller 30 in an arrow direction. Following rotation of the fixing roller 30, the film 51 of the pressing unit 50 rotates in an arrow direction while sliding on the flat surface 52A of the film guide 52 at the inner peripheral surface thereof. Further, following rotation of the fixing roller 30, the film 22 of the heating unit 20 rotates in an arrow direction while sliding on the protective layer 21C of the heater 203 at the inner peripheral surface thereof The electrode 21F (part (b) of FIG. 4) of the heater 21 is connected with a commercial power source 41 via a triac 40 shown in FIG. 5. The commercial power source 41 supplies electrical power to the heat generating resistor 21B via the electroconductive portion 21E shown in FIG. 4. Further, the heat generating resistor 21B generates heat by energization, so that the heater 21 abruptly increases in temperature and heats the surface of the fixing roller 30 via the film 22 at the heating nip N2.

The controller 103 acquires a detection temperature of the main thermistor 23A, for monitoring the temperature of the heater 21 as shown in FIG. 5, via an analog/digital (A/D) converting circuit 42. Then, the controller 103 controls electrical power supplied to the heater 21 by controlling ON/OFF of the triac 40 so that the detection temperature is maintained at a fixing temperature (target temperature) (i.e., the detection temperature is controlled).

The recording material P, on which an unfixed toner image T is formed, is heated by heat of the fixing roller surface while being nipped and fed by the surface of the fixing roller 30 and the outer peripheral surface of the film 51 at the fixing nip N1. As a result, the unfixed toner image T is fixed on the recording material P. After the recording material P, on which the toner image T is fixed, is discharged from the fixing device 102, the controller 103 stops rotational drive of the motor M1 after a predetermined condition is satisfied. Further, the controller 103 turns off the triac 40 and thus stops energization to the heater 21.

Rotation Detecting Process/Operation of Fixing Member

Detection of rotation or non-rotation (rotational state) of the fixing roller 30 as the fixing member in this embodiment is sequentially carried out in the following procedure as a rotation detecting process.

(1) Energization to the heater is made, and the heater is increased in temperature until a temperature T of the thermistor 23A reaches a predetermined temperature $T_{start}$. At this time, energization to the motor is not made.

(2) The energization to the heater is stopped, and the energization to the motor is made.

(3) After a lapse of a predetermined time ST, the energization to the motor is stopped, and the temperature of the thermistor 23A at that time is $T_{ST}$.

(4) A highest temperature detected by the thermistor 23A in a period from the start of the energization to the motor to the stop of the energization to the motor is $T_{max}$.

(5) As temperature lowering information, which is a change amount of the detection temperature of the thermistor 23A, a temperature lowering rate $(T_{max}-T_{ST})/T_{max}$ is calculated.

(6) When the temperature lowering rate exceeds a predetermined threshold X, the controller discriminates that the fixing member (fixing roller 30) rotates (rotation), and, when the temperature lowering rate is below the predetermined threshold X, the controller discriminates that the fixing member (fixing roller 30) does not rotate (non-rotation). When the fixing member rotates correspondingly to the energization to the motor, after a lapse of the predetermined time ST, the heat of the heater is conducted to an entirety of the fixing member with respect to a circumferential direction, and, therefore, the temperature of the thermistor 23A contacting the heater is expected to lower. Accordingly, the temperature lowering rate is the basis for discrimination of the rotation or the non-rotation of the fixing member.

A value of the temperature $T_{start}$ may desirably be set at a high temperature within a range in which the heating unit 20 and the fixing roller 30 are not affected by deformation, or the like, due to the heat. Further, a value of the time ST may desirably be set from the viewpoint of detection accuracy so that a difference between the temperature $T_{ST}$ during normal rotation (in the case of rotation) and the temperature $T_{ST}$ during non-rotation (in the case of non-rotation) becomes a maximum, but, when the difference is sufficiently ensured, a value lower than the above-described value may also be set.

Further, a value of the threshold X is set as a value capable of demarcating the temperature lowering rate during the normal rotation and the temperature lowering rate during the non-rotation. The value of the threshold X may desirably be set at approximately an average of the temperature lowering rate during the normal rotation and the temperature lowering rate during the non-rotation.

FIG. 6 is a flowchart showing a rotation detection sequence in this embodiment, and this sequence is stored in the memory of the controller 103 (FIG. 1). The controller 103 not only stores the temperature T acquired from the main thermistor 23A but also causes the heater 21 to generate heat by energizing the heater 21 via the triac 40 (FIG. 5) (step S1). The controller 103 continuously monitors the thermistor temperature T and heats the heater 21 until the thermistor temperature T satisfies T>110° C., and, when the thermistor temperature T exceeds 110° C., the controller 103 stops the energization and thus, stops the heating (steps S2, S3). In that state, the controller 103 makes energization to the motor M1, and thus, starts drive of the motor M1 (step S4).

Then, as regards the thermistor temperature T continuously detected, the highest temperature is stored as $T_{max}$ (step S5). The driving operation is continued to a lapse of 2.5 seconds (the value of the above-described predetermined time) from the start of the drive, and the thermistor temperature after the lapse of 2.5 seconds is stored as $T_{2.5}$ (the value of the above-described $T_{ST}$ (steps S6, S7).

Then, as the temperature lowering information, a value (temperature lowering rate) obtained by dividing a difference between the highest temperature $T_{max}$ and the temperature $T_{2.5}$, which is the temperature after the lapse of 2.5 seconds from the drive start, by the highest temperature $T_{max}$. When the temperature lowering rate exceeds 0.2, which is the value of the threshold X, the controller 103 discriminates that the fixing roller 30 accurately rotates, and, when the temperature lowering rate does not exceed 0.2, the controller 103 discriminates that the fixing roller 30 does not rotate (S8, S9, S10).

Incidentally, the values, such as 110° C., as a trigger for the drive start, the time of 2.5 seconds from after the stop of the energization to the heater 21 until the temperature $T_{2.5}$ is measured, and 0.2, which is the threshold of the temperature lowering rate, are not limited thereto. That is, these values can be set at values capable of detecting the drive in a most appropriate manner depending on the constitution of the fixing device 102.

In this detecting method, after the heater 21 and the fixing roller 30 are increased in temperature by stop-state heating (in which the energization to the motor is not made but the heater is heated), the energization to the motor is started in a state in which the heating of the heater is stopped. In a case in which a driving force from the motor M1 is transmitted to the fixing roller 30, the film 22 of the heating unit 20 is rotationally driven. At this time, the heat of the heater 21 is moved to the fixing roller 30 side via the film 22, so that the thermistor temperature T detected by the main thermistor 23A largely lowers.

On the other hand, in a case in which the driving force from the motor M1 is not transmitted to the fixing roller 30, the film 22 of the heating unit 20 is not rotationally driven, so that the heat of the heater 21 is not readily moved to the fixing roller side. Therefore, the thermistor temperature T detected by the main thermistor 23A is not so lowered. That is, depending on whether or not the driving force from the motor M1 to the fixing roller 30 side, a large difference generates in degree of the lowering in thermistor temperature T, and, therefore, the detecting method in this embodiment uses this phenomenon.

FIG. 7 shows a change in thermistor temperature T with time in this embodiment. A temperature change in the case in which the driving force from the motor M1 is transmitted to the fixing roller 30 (i.e., in the case of rotation) is indicated by a solid line, and a temperature change in the case in which the driving force from the motor M1 is not transmitted to the fixing roller 30 (in the case of non-rotation) is indicated by a solid line. As regards the temperature rise during the stop-state heating, substantially no difference generate between both cases, and the difference increases after the heating is stopped and the drive is started.

In both of the case of rotation of the fixing roller 30 and the case of non-rotation of the fixing roller 30, the highest temperature $T_{max}$ is the same (115° C.), but the temperature $T_{2.5}$ is 40° C. in the case of rotation of the fixing roller 30, and is 100° C. in the case of non-rotation of the fixing roller 30. When these temperatures are represented by the temperature lowering rates, the temperature lowering rate in the case of rotation is 0.65, and the temperature lowering rate in the case of non-rotation is 0.13. As a result, when the value of 0.2 is used as the above-described threshold X, the rotation or non-rotation (rotational state) of the fixing roller 30 can be detected.

As described above, according to this embodiment, the rotational state of the rotatable member is detected on the basis of a change amount of the detection temperature of the temperature detecting member in a period in which the motor is rotated at a predetermined rotational speed in a state in which the electrical power supply to the heat generating member is stopped after predetermined electrical power is supplied to the heat generating member. Specifically, the rotational state of the rotatable member is detected after the lapse of predetermined time from the start of rotation of the motor at the predetermined rotational speed in the state in which the electrical power supply to the heat generating member is stopped.

For this reason, in a simple constitution, it is possible to suppress (prevent) the thermal deformation of the fixing member due to non-transmission of the driving force to the motor M1 and an image defect due to the thermal deformation.

Second Embodiment

This embodiment is basically similar to the First Embodiment, but, as shown in FIG. 8, is different from the First Embodiment in that a step SS6 is added in the case of "NO" of step S6. FIG. 8 is a flowchart showing a rotation detecting sequence in this embodiment. In the case of "NO" of step S6, step SS6, in which the temperature lowering rate is calculated as the temperature lowering information and is compared with the threshold X is carried out. As a result, a detecting speed during the normal rotation can be improved.

That is, in this embodiment, when the temperature $T_{2.5}$ is detected, the thermistor is not on stand-by for a lapse of the predetermined time (2.5 seconds), but the detection of the rotation of the fixing member corresponding to the energization to the motor is carried out in real time. That is, at a current thermistor temperature, the temperature lowering rate is calculated in real time. Then, even before the lapse of 2.5 seconds, in a stage in which the temperature lowering rate exceeds the threshold, the detection is terminated and the controller discriminates that the rotatable member normally rotates. For this reason, higher speed detection can be made.

In the First Embodiment, the detection of the rotation or the non-rotation was carried out on the premise of first control, in which the energization to the heater is made, second control, in which the energization to the motor is made in a state in which the energization to the heater is stopped, and third control, in which the energization to the motor is stopped, in the state in which the energization to the heater is stopped. In this embodiment, however, on the basis of the temperature lowering information when the third control is not carried out, but the second control is carried out, the detection of the rotation or the non-rotation of the fixing member is made.

As described above, according to this embodiment, the rotational state of the rotatable member is detected on the basis of a change amount of the detection temperature of the temperature detecting member in a period in which the motor is rotated at a predetermined rotational speed, in a state in which the electrical power supply to the heat generating member is stopped, after predetermined electrical power is supplied to the heat generating member. Specifically, the rotational state of the rotatable member is detected on real time from the start of rotation of the motor at the predetermined rotational speed in the state in which the electrical power supply to the heat generating member is stopped.

For this reason, in a simple constitution, it is possible to suppress (i.e., to prevent) the thermal deformation of the fixing member due to non-transmission of the driving force to the motor M1 and an image defect due to the thermal deformation.

Third Embodiment

This embodiment is basically similar to the First Embodiment, but, as shown in FIG. 9, is different from the First Embodiment in that a mechanism for spacing and contacting between the motor M1 and the gear G1 (i.e., a mechanism for shutting off and connecting drive transmission from the motor M1 to the fixing roller 30 as the fixing member) is provided in the fixing device 102. Further, in this embodiment, as shown in FIG. 10, before step S1, a step PS1, in which a gear G2 for connecting a gear G3 and the gear G1 is inserted between the gears G1 and G3, is carried out.

Parts (a) and (b) of FIG. 9 are front views each showing a schematic structure of the fixing device 102 as seen from an upstream side with respect to the recording material feeding direction. When a recovering process from sheet (paper) jam during printing, or a similar process, is carried out, there is a need to discharge the recording material P nipped in the fixing nip N1, but, for the purpose of alleviating a driving torque at that time, a drive connection mechanism as shown in FIG. 9 is provided.

The gears G2 and G3 are disposed between the motor M1 and the gear G1, and the gear G2 can be switched between a state in which the gear G2 is inserted into between the gears G1 and G3 by a cam 61, and a state in which the gear G2 is demounted from between the gears G1 and G3 by the cam 61. The cam 61 and a gear 62 are provided coaxially with each other, and the gear 62 is driven by a motor M2. Part (a) of FIG. 9 shows a state in which the gear G2 is demounted, and part (b) of FIG. 9 shows a state in which the gear G2 is inserted. The above-described mechanism is an example of the drive connection mechanism, however, and a mechanism other than the above-described mechanism may also be used.

FIG. 10 is a flowchart showing a rotation detecting sequence in this embodiment. Before step S1, step (step for sending a signal, for drive transmission, to the drive connection mechanism) PS1, in which the gear G2 is inserted into between the gears G1 and G3, is carried out. Although the sequence goes to step S1 via step PS1, in a case in which the non-rotation is detected in step S10, the controller can discriminate that an abnormality occurs in the drive connection mechanism.

Fourth Embodiment

This embodiment is different from the Third Embodiment in that, after step S10, a drive restoring step AS2 is carried out.

Incidentally, in FIG. 11, step PS1 (step for inserting the gear 2, performed before step S1) in FIG. 10 is omitted, but step S1 is performed in this embodiment in actuality.

Referring to FIG. 11, which is a flowchart showing a rotation detecting sequence in this embodiment, step AS2 for restoring the drive is carried out after the temperature lowering rate is discriminated as being not more than 0.2 in step S2 and the fixing member is discriminated as being in the non-rotation state in step S10. As such a drive restoring operation, an inserting/demounting operation is used, so that an improper operation of the gear G2 can be improved.

Fifth Embodiment

FIG. 12 shows a fixing device 102 of a film heating type according to a Fifth Embodiment. The fixing device 102 shown in FIG. 12 includes the heating unit 20 and a pressing roller 70 having the same constitution as the fixing roller 30 in the First Embodiment. The pressing roller 70 includes a metal core 70A, an elastic layer 70B, and a parting layer 70C. The rotation detecting sequence (FIG. 6) is executed by the controller 103 of the fixing device 102 in this embodiment, whereby a functional effect that is the same as that of the First Embodiment can be obtained. Further, when the drive connection mechanism in the Third Embodiment is provided in the fixing device 102 in this embodiment and the rotation detecting sequence (FIG. 10) is executed, a functional effect that is the same as that of the Third Embodiment can be obtained.

Comparison Example

This comparison example is basically similar to the First Embodiment (FIG. 6), but, as shown in FIG. 13, step S3 in FIG. 6 is not performed.

FIG. 13 is a flowchart of a rotation detection process in this comparison example. In the First Embodiment (FIG. 6), the energization to the heater 21 is stopped before the drive starts, but, in this comparison example, even when the thermistor temperature T exceeds 110° C., the drive is started without stopping the energization to the heater 21.

FIG. 14 shows a change in thermistor temperature T with time in this comparison example. A temperature change in a case in which the driving force from the motor M1 is transmitted to the fixing roller 30 (i.e., during the drive) is indicated by a solid line, and a temperature change in a case in which the driving force from the motor M1 is not transmitted to the fixing roller 30 (during the non-drive) is indicated by a solid line. As regards the temperature rise during the stop-state heating (in which the heater generates heat in a state in which the drive is stopped), substantially no difference generates between both cases, and the difference increases after the drive is started.

In this comparison example, the highest temperature $T_{max}$ during the drive was 130° C., and the heater $T_{max}$ during the non-drive was 150° C. Further, the temperature $T_{2.5}$ during the drive is 124° C., and, on the other hand, the temperature $T_{2.5}$ during the non-drive is 145° C. When these temperatures are represented by the temperature lowering rates, the temperature lowering rate during the drive is 0.046, and the temperature lowering rate during the non-drive is 0.033, so that these temperature lowering rates are close to each other. Thus, in a case in which the energization to the heater 21 is continued, even when the drive is started, the thermistor temperature lowers by a small amount, so that a relationship between the temperature lowering rates is reversed by a slight fluctuation.

Comparison Result Between Comparison Example and First to Fifth Embodiments

FIG. 15 is a table showing a comparison result of a check on an image defect caused by the fixing device in which the normal rotation is detected and on occurrence or non-occurrence of deformation of the fixing roller after the detecting operation, between the comparison example and the First to Fifth Embodiments (present invention). In the above-described method of detecting the temperature lowering rate by the thermistor, the detecting operation is performed in a state in which the heater 21 does not generate the heat, and, therefore, a temperature difference between a time period during the drive and a time period during the non-drive becomes large, so that detection accuracy is high. Further, the detection is carried out in a state of no energization to the heater 21, and, therefore, erroneous detection due to factors, such as variations in resistance of the heater and electrical power supplied, can be eliminated.

Modified Embodiments

In the First to Fifth Embodiments described above, preferred embodiments of the present invention were explained, but the present invention is not limited thereto, and can be variously modified and changed within the scope of the present invention.

Modified Embodiment 1

In the above-described Fifth Embodiment (FIG. 12), the constitution, in which the fixing device, in which the film 22 was heated by the ceramic heater 21, was described, and in which the temperature detecting member was contacted to the ceramic heater 21, was employed. The present invention is also, however, applicable to a fixing device different from this fixing device. For example, the present invention is also applicable to a fixing device in which the film is heated using electromagnetic induction. In this case, a constitution in which the temperature detecting member is contacted to the film, which is an endless belt, is employed.

Modified Embodiment 2

In the above-described First to Fifth Embodiments, in order to detect the rotation or the non-rotation of the fixing member, the temperature lowering rate was acquired, but, in place of the temperature lowering rate, a temperature lowering amount ($T_{max}-T_{ST}$) can also be used.

Modified Embodiment 3

In the above-described First to Fifth Embodiments, as the first control, the energization of the heater was carried out in the state in which the energization to the motor was stopped. The present invention is not, however, limited thereto, but as the first control, the energization to the heater was capable of being carried out without stopping the energization to the motor.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. A fixing device comprising:

a first rotatable member;

a second rotatable member in contact with an outer surface of said first rotatable member, and configured to form a nip in cooperation with said first rotatable member so that a recording material, on which a toner image is formed, is nipped and fed in the nip;

a heat generating member configured to heat said first rotatable member;

a temperature detecting member configured to detect a temperature of said heat generating member;

a motor configured to drive one of said first rotatable member and said second rotatable member; and a controller configured to control said fixing device, said controller causing said motor to rotate in a state in which a predetermined amount of electrical power is supplied to said heat generating member, and then, supply of the electrical power to said heat generating member is stopped, and, on the basis of a temperature lowering rate of a detected temperature of said temperature detecting member during rotation of said motor, said controller detects, after stopping supply of the electrical power to said heat generating member, a rotational state of said one of said first rotatable member and said second rotatable member.

2. The fixing device according to claim 1, wherein, when the predetermined amount of electrical power is supplied to said heat generating member, said controller causes said motor to stop rotation.

3. The fixing device according to claim 1, wherein said controller detects the rotational state after a lapse of a predetermined time from a start of rotation of said motor at a predetermined rotational speed of said motor.

4. The fixing device according to claim 1, further comprising a drive connection mechanism configured to perform one of a shut off operation and a permit drive transmission operation from said motor to said one of said first rotatable member and the second rotatable member after sending a drive connection signal to said drive connection mechanism.

5. The fixing device according to claim 4, wherein said drive connection mechanism includes a gear capable of being inserted into and detached from between said motor and said one of said first rotatable member and said second rotatable member, and configured to transmit a drive force from said motor to said one of said first rotatable member and said second rotatable member.

6. The fixing device according to claim 1, wherein said first rotatable member is a fixing roller including a metal core and an elastic layer formed on said metal core, and wherein said heat generating member is in contact with the outer surface of said fixing roller.

7. The fixing device according to claim 1, wherein said first rotatable member is an endless belt, and wherein said heat generating member is provided opposed to said second rotatable member through said endless belt at the nip.

8. The fixing device according to claim 7, wherein said heat generating member is a heater generating heat by supplying the electrical power, and wherein said heater is in contact with an inner surface of said endless belt.

* * * * *